US012221761B2

(12) United States Patent
Combs et al.

(10) Patent No.: US 12,221,761 B2
(45) Date of Patent: Feb. 11, 2025

(54) SUPPORT SYSTEM FOR FOUNDATION WALLS

(71) Applicant: Intech Anchoring Systems, Caseyville, IL (US)

(72) Inventors: Tim Combs, St. Jacob, IL (US); Sam Pappas, Caseyville, IL (US)

(73) Assignee: Midwest Diversified Technologies U.S., LLC, Caseyville, IL (US)

( * ) Notice: Subject to any disclaimer, the term of this patent is extended or adjusted under 35 U.S.C. 154(b) by 152 days.

(21) Appl. No.: 17/991,042

(22) Filed: Nov. 21, 2022

(65) Prior Publication Data

US 2023/0167621 A1 Jun. 1, 2023

Related U.S. Application Data

(60) Provisional application No. 63/282,270, filed on Nov. 23, 2021.

(51) Int. Cl.
*E02D 31/10* (2006.01)

(52) U.S. Cl.
CPC ..... *E02D 31/10* (2013.01)

(58) Field of Classification Search
CPC ..... E02D 31/10; E04B 2001/2688; E04G 23/0218
USPC ..... 52/127.1, 127.2, 223.1, 291, 292, 514
See application file for complete search history.

(56) References Cited

U.S. PATENT DOCUMENTS 3,030,061 A * 4/1962 Jennings ..... E04G 17/14 403/53
3,464,103 A * 9/1969 Harris ..... B23P 6/04 52/514
5,845,450 A * 12/1998 Larsen ..... E02D 35/00 248/354.3
6,073,405 A * 6/2000 Kasai ..... E04B 1/2403 52/283
6,357,190 B1 * 3/2002 Florentine ..... E02D 37/00 52/514
7,380,372 B2 * 6/2008 Resch ..... E04G 23/0218 52/150

(Continued)

OTHER PUBLICATIONS

Website—https://www.woodsbasementsystems.com/; accessed Oct. 17, 2021.

*Primary Examiner* — Brian E Glessner
*Assistant Examiner* — Adam G Barlow
(74) *Attorney, Agent, or Firm* — Jonathan P. Soifer; Sandberg Phoenix & von Gontard, PC

(57) ABSTRACT

A wall supporting system for supporting a foundation wall against forces applied externally to the wall comprises a support beam having a bottom end and a top end, a floor bracket adapted to maintain the bottom end of the support beam adjacent the wall, and an upper bracket. The upper bracket comprises a main plate facing the wall, and an internally threaded passage opening into said main plate and defining an axis generally perpendicular to the main plate, a torque bolt threadably received in the internally threaded passage, and a beam connector at an end of the torque bolt, wherein the beam connector is adapted to be generally rotationally fixed relative to support beam while the torque bolt can rotate relative to the beam connector, such that advancement of the torque bolt will advance the beam connector to urge the support beam into a compressive relationship with the wall.

20 Claims, 14 Drawing Sheets

(56) References Cited

U.S. PATENT DOCUMENTS

| | | | | |
|---|---|---|---|---|
| 7,419,335 | B1 * | 9/2008 | Cohen | E04G 23/0229 52/223.13 |
| 7,681,367 | B2 * | 3/2010 | Morton | E02D 37/00 52/514 |
| 7,913,463 | B2 * | 3/2011 | Russell | E04G 17/14 52/651.1 |
| 8,136,317 | B1 * | 3/2012 | McCown | E04G 23/0229 52/514 |
| 8,925,267 | B1 * | 1/2015 | Kirby | E04G 23/0218 52/514 |
| 9,091,090 | B1 * | 7/2015 | Kirby | E04G 23/0229 |
| 10,612,254 | B2 * | 4/2020 | Waltz | E02D 5/08 |
| 10,669,730 | B1 * | 6/2020 | Taylor | E04G 23/0229 |
| 11,186,992 | B2 * | 11/2021 | Jie | E04B 5/023 |
| 2006/0080926 | A1 * | 4/2006 | Resch | E04G 23/0229 52/474 |
| 2006/0137278 | A1 * | 6/2006 | Heady | E02D 37/00 52/514 |
| 2007/0227082 | A1 * | 10/2007 | Morton | E04G 23/0218 52/127.2 |
| 2019/0360221 | A1 * | 11/2019 | Gantt | E04G 23/04 |

* cited by examiner

SUPPORT SYSTEM FOR FOUNDATION WALLS

CROSS-REFERENCE TO RELATED APPLICATIONS

This application claims priority to U.S. App. No. 63/282,270, filed Nov. 23, 2021 entitled "Support System for Foundation Walls", said application being incorporated herein by reference.

STATEMENT REGARDING FEDERALLY SPONSORED RESEARCH OR DEVELOPMENT

Not Applicable.

BACKGROUND

This application relates to a support system for foundation walls, and in particular to a wall support system that can provide support to, or reinforce, existing foundation walls (such as load bearing and non-load bearing basement foundation walls) without the need to excavate the exterior of the foundation wall.

Moisture in the soil (such as clay soil) surrounding a building's foundation expands, and can put extensive pressure on the building's foundation. This hydrostatic pressure can, over time, cause basement walls to crack, bend, and/or more inwardly if there is insufficient drainage. Foundation walls need to be reinforced if they have cracked, bent, or moved due such hydrostatic pressures. One solution to such foundation issues includes wall anchors using cables extending from the foundation to an anchor point outside the foundation. Another solution includes installing channel anchors externally of the foundation and then boring through the foundation wall to anchor the wall to the external channel anchors.

Such systems have the drawback that they require at least partial excavation of the foundation's exterior and can require boring or drilling through the foundation and/or foundation walls. This makes such systems disruptive to the area immediately surrounding the building and expensive to install. It would be desirable to provide a foundation wall support system that does not require excavation of the foundation or otherwise require drilling through the foundation or foundation walls.

BRIEF SUMMARY

Briefly stated, a wall supporting system is disclosed for supporting or reinforcing a foundation wall against forces applied externally to the wall. The system comprises a support beam having a bottom end and a top end, a floor bracket adapted to maintain the bottom end of the support beam adjacent the wall; and an upper bracket.

The upper bracket comprises a main plate arranged to be generally parallel to the foundation wall when the wall supporting system is in place. A passage extends through said main plate. The passage is open at opposite ends and defines an axis generally perpendicular to the main plate. A torquing member is received in the passage to be movable through said passage. Finally, a beam connector is mounted at an end of the torquing member. Whereby, advancement of the torquing member relative to the main plate will advance the beam connector to urge the support beam into a compressive relationship with the foundation wall. The torquing member and passage are shaped and configured to positively engage each other such that the torquing member will be substantially prevented from retracting from said passage after torquing member has been advanced.

According to an aspect, the passage is a threaded passage, and the torque member comprises a torquing bolt which is at least partially threaded. The torquing bolt can rotate relative to the beam connector, such that the beam connector remains generally rotationally fixed in position relative to support beam as the torquing bolt is advanced. In an embodiment, the passage is defined by a tube or member (such as a nut or the like) which extends from a surface of the main plate.

According to an aspect of the wall supporting system the floor bracket comprises a floor plate adapted to be secured to a floor and a back plate.

According to an aspect of the wall supporting system the beam connector comprises a face plate and arms extending from the face plate in a direction to extend away from the main plate, such that the connector defines a channel sized to receive the support beam.

According to an aspect of the wall supporting system the arms comprise a base adjacent the face plate and a distal end, the arms being wider at their bases than at their free ends.

According to an aspect of the wall supporting system the beam connector comprises a hollow tube sized to rotatably receive the torquing member.

According to an aspect of the wall supporting system the upper bracket is adapted to be mounted between joists that extend generally perpendicularly to the wall to be supported.

In accordance with this aspect, the upper bracket comprises opposed joist mounting members and a center span extending between the joist mounting members; the center span comprising the main plate; wherein the center span is adjustably connected to the joist mounting members.

In accordance with this aspect, the joist mounting members each comprise a side plate and a back plate; the back plates each comprising an opening and the main plate comprising opposed mounting openings proximate opposite ends of the main plate; the wall supporting system further comprising fasteners extending through the openings when aligned to secure the center span to the joist mounting members; wherein one of the openings is an elongate opening whereby the relative position of the center span relative to the joist mounting members can be laterally adjusted.

In accordance with this aspect, the center span comprises a top plate extending generally perpendicularly to the main plate.

In accordance with this aspect, either or both of the center span and the joist mounting members comprise at least one stiffening plate.

In accordance with another aspect, the upper bracket is adapted to be mounted to blocking extending between joists that extend generally parallel to the wall to be supported.

In accordance with this aspect, the upper bracket comprises a front plate spaced forwardly of the main plate and side members extending between the front and main plate plates; the side members extending above upper edges of the front and main plates to define a gap therebetween.

In accordance with this aspect, the side members comprise a back plate.

In accordance with this aspect, the side members comprise flanges extending outwardly from the back plate.

In accordance with this aspect, the side members define at least one mounting hole; the mounting hole being above top edges of the front and main plates.

In accordance with this aspect, the front plate defines a hole aligned with the hole of the main plate, whereby the torquing member can be accessed through the front plate.

In accordance with this aspect, the upper bracket includes a top plate extending from an upper edge of the front plate, preferably in a direction away from the main plate.

In another aspect, a method is disclosed for installing the wall support system described above to reinforce a foundation wall of a building have a floor at a bottom of the foundation wall and a ceiling at a top of the foundation wall, and wherein the ceiling comprises joists. The method comprises positioning the support beam on the wall such that the support beam extends from the floor to a point above a bottom surface of the joists, securing the floor bracket to the floor to maintain the bottom of the support beam adjacent a bottom of the foundation wall; mounting the upper bracket in the ceiling to be aligned with the support beam such that the beam connector is in contact with the support beam, and advancing the torquing member to urge the support beam against the foundation wall to counter external pressures being applied against the wall.

In accordance with an aspect of the method, when the joists extend generally perpendicularly to the foundation wall; the method comprises securing the floor joist mounts to adjacent floor joists and securing the center span to the floor joist mounts in a position generally centered between the floor joist mounts. In accordance with this aspect, the method includes loosely connecting the center span to the floor joist mounts prior to securing the floor joist mounts to the joists.

In accordance with an aspect of the method, when the joists extend generally parallel to the foundation wall; the method comprises installing bracing between at least two and preferably at least four joists, such that the bracing is aligned with the support beam, mounting the upper bracket to the bracing behind joist closest to the wall, and mounting a reinforcement strap to the bracing and/or joists, wherein the reinforcing strap has a forward edge positioned adjacent the upper bracket.

BRIEF DESCRIPTION OF THE DRAWINGS

Corresponding reference numerals will be used throughout the several figures of the drawings.

DETAILED DESCRIPTION

Figure 1A:
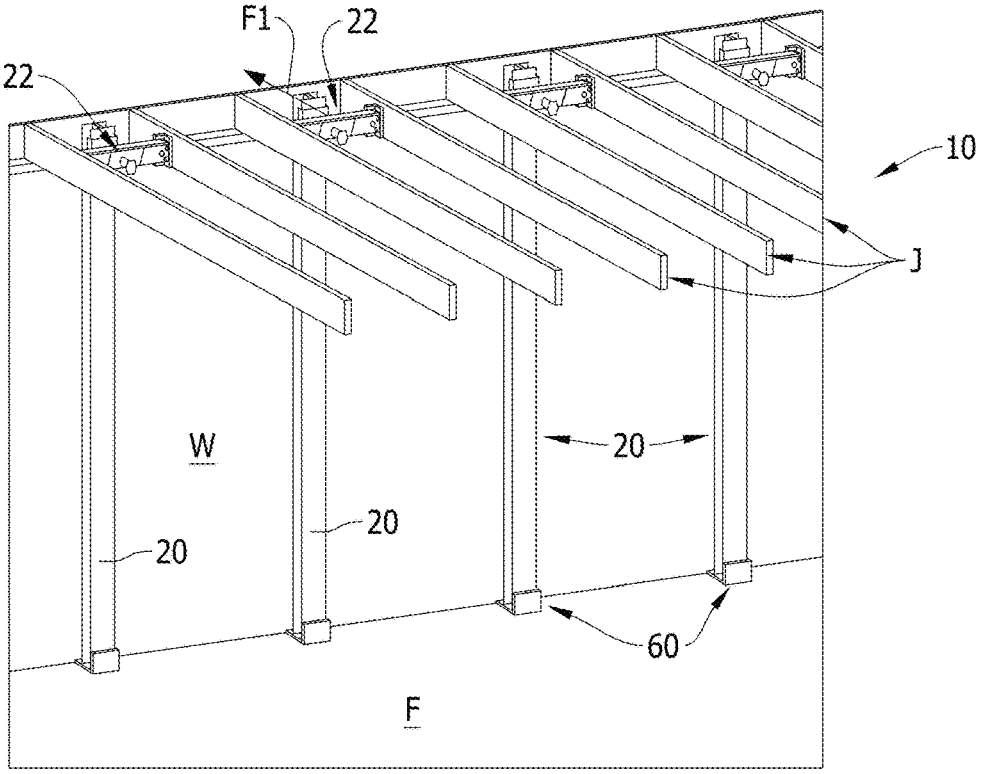
FIGS. 1A-B are schematic perspective views of a foundation support system for use with joists running perpendicular and parallel, respectively, to the wall to be reinforced when installed in the basement of a building (with the joists in FIG. 1B being shown in phantom)

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what is presently believed is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 1B:
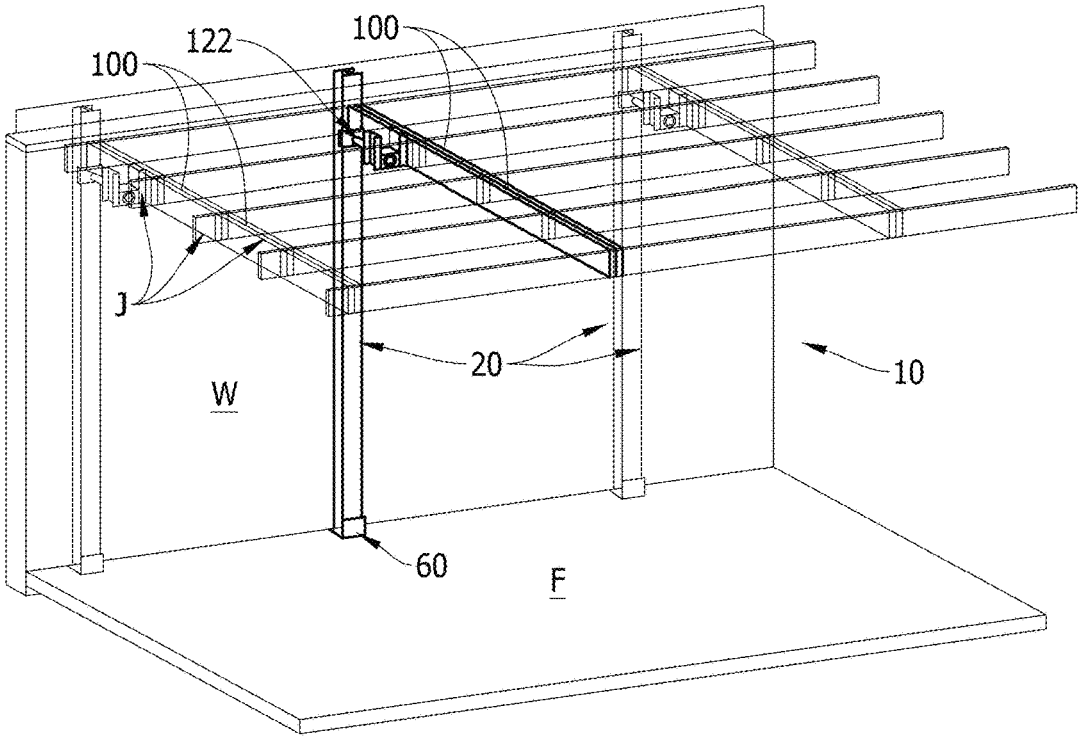

A foundation wall support system 10 is shown in FIGS. 1A-B installed in a basement having a floor F and a wall W to be reinforced. In FIG. 1A, the foundation wall support system is shown reinforcing a wall W in which the joists J of the basement ceiling extend perpendicular to the wall W to be reinforced. In FIG. 1B, on the other hand, the foundation wall support system is shown reinforcing a wall W in which the joists J of the basement ceiling extend parallel to the wall W to be reinforced. In both cases, the foundation wall support system comprises a support beam 20 extending from the basement floor F to a point above the wall W and preferably slightly below the top of the ceiling joists J. The support beam 20 preferably has a flat side which, when installed, is adjacent the wall W to have surface contact with the wall W. Preferably, the support beam 20 is an I-beam with the flange of the I-beam adjacent the wall. As will be explained below, this will allow the support beam to exert a pressure on the wall over the entire surface which is in contact with the wall to counter the hydrostatic forces causing the wall to bow or tilt inwardly.

The support beam 20 is secured in place at top thereof by an upper bracket 22, 122 which is mounted in the ceiling either between adjacent joists J for a perpendicular system as shown in FIG. 1A or to blocking 100 extending between joists of the ceiling for a parallel system as shown in FIG. 1B. At its bottom, the support beam 20 is held against the wall by a toe or floor bracket 60. The support system 10 thus comprises three basic components: the beam 20, the upper bracket 22, 122, and the toe bracket 60.

FIGS. 2A-E show the upper perpendicular bracket 22, and FIGS. 3A-4C show the components of the upper perpendicular bracket. The upper perpendicular bracket 22 comprises a center span 30 which is supported between, and operatively connected to, adjacent joists J by right and left joist mounts 40. As will be described in more detail below, the support beam 20 is adjacent the wall W in alignment with the bracket 22. The support beam is partially surrounded by a beam connecter 50. A torquing member 24, in the form of a torque bolt, passes through bracket 22 to be received by the beam connector 50. As described below, torque is applied to the bolt 24 to "push" the support beam 20 against the wall to support or reinforce the wall W. The pressure provided by the system 10 against the basement wall W counters the forces of the soil external of the foundation wall W.

Figure 3A:
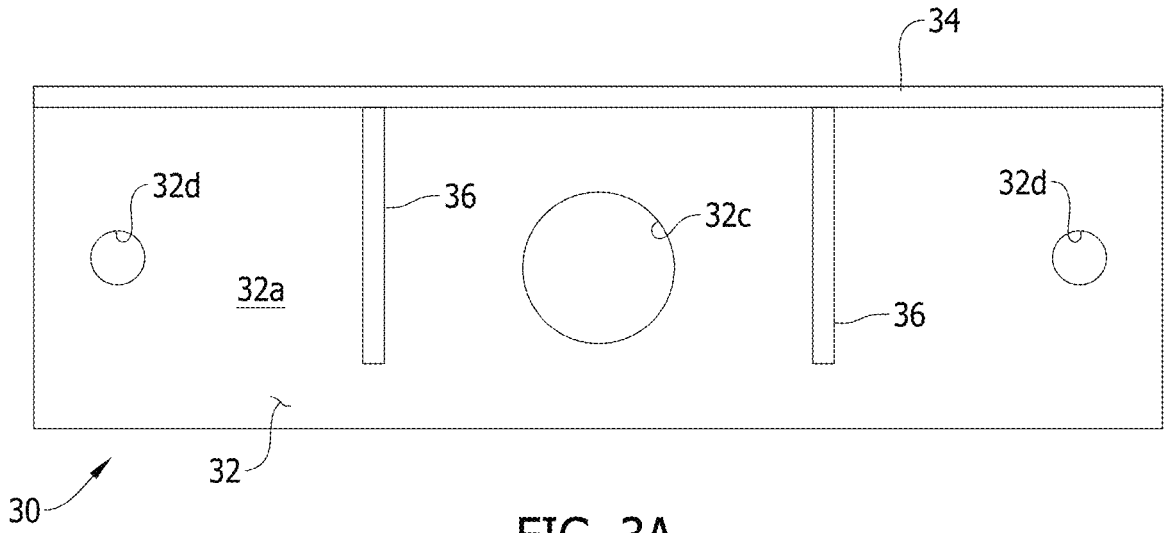
FIGS. 3A-B are front and side elevational views, respectively, of a center span of an upper perpendicular bracket of the foundation support system.
Figure 3B:
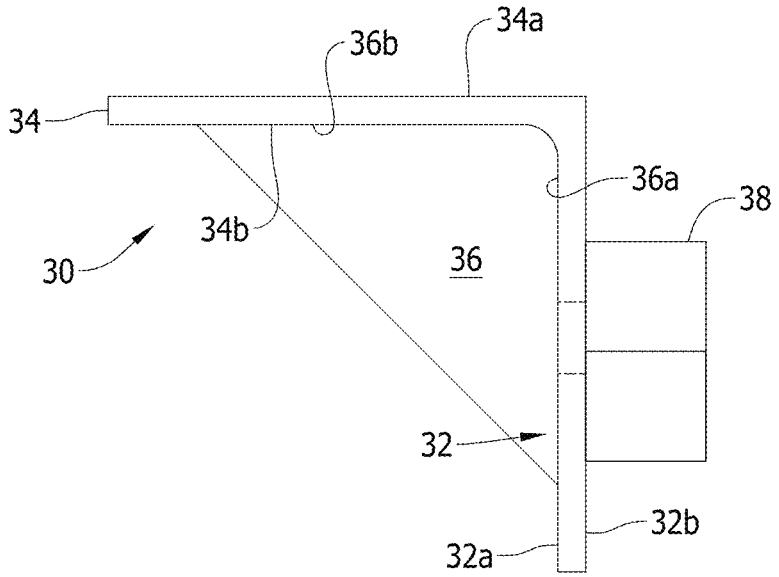

The center span 30 is shown in detail in FIGS. 3A-B. The center span 30 comprises a main plate 32 and a top plate 34 which is generally perpendicular to the main plate 32. The main plate 32 has a front surface 32*a* and a back surface 32*b*; and the top plate 34 has a lower surface 34*a* and an upper surface 34*b*. A pair of stiffeners 36, which are shown to be triangular, extend generally perpendicularly to both the front surface 32*a* of the main plate 32 and the lower surface 34*a* of the top plate 34. The stiffeners 36 have edges 36*a,b* which are fixed (such as by welding) to the main plate 32 and top plate 34. The stiffeners are preferably generally right triangles wherein the two edges 36*a,b* are of approximately equal length. The stiffeners 36 are positioned on the center span to divide the center span into approximately equal thirds. A center hole 32*c* is formed in the main plate approximately midway between the two stiffeners 36, and mounting holes 32*d* are formed in the main plate spaced inwardly slightly from side edges of the main plate. The mounting holes 32*d* are positioned to be approximately midway between the top and bottom edges of the main plate 32. The center hole 32*c* has a center that is shown to be slightly below the center of the two mounting holes 32*d*. However, the centers of the three holes can be cl-linear. As shown in FIGS. 3A-B, the main plate 32 has a single mounting hole on each side of the center span. The center span, however, could be formed with opposed pairs of vertically spaced mounting holes, as is evident from FIG. 2B. A tube 38, in the form of an internally threaded member, extends from the back surface 32*b* of the main plate 32 to be aligned with the hole 32*c*. This tube 38 can be formed from a nut or internally threaded tube which is mounted, such as by welding, to the back surface 32*b* of the main plate 32. If the main plate 32 is sufficiently thick, the tube can be dispensed with, and the passage defined by the tube can be formed directly in the main plate 32.

In a preferred embodiment, the center span 30 preferably has a side-to-side width of about 13¼" and a height of about 4". The stiffeners 36 have legs 36*a,b* that are about 3" long. The mounting holes 32*d* have centers that are about 2" above the bottom edge of the main plate 32 and are sized to accept a ⅝ diameter bolt. The central opening 32*c* has a center that is about ⅛" above the bottom edge of the main plate 32 and is sized to receive a 1¼ " diameter bolt. The center span 30 is preferably made from ¼" thick steel plating, but could be formed from any material which can withstand the forces to which the center span 30 will be subject when installed.

Figure 4A:
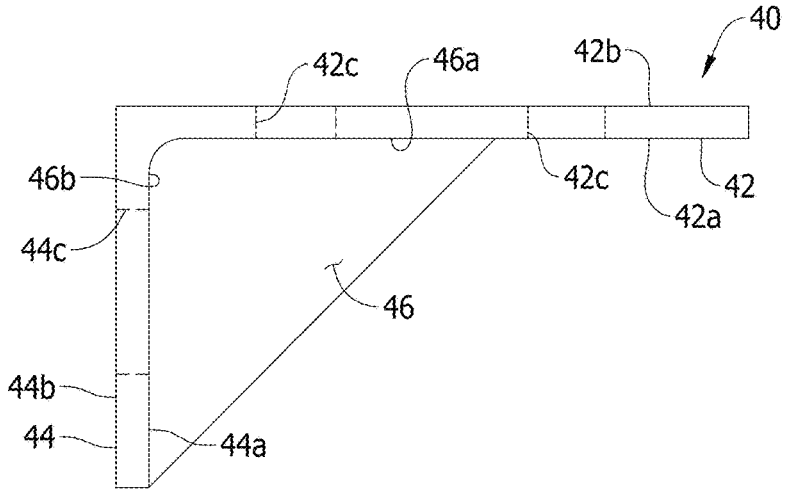
FIGS. 4A-C are top plan, front elevational, and side elevational views, respectively of a floor joist mount of the upper perpendicular bracket.
Figure 4B:
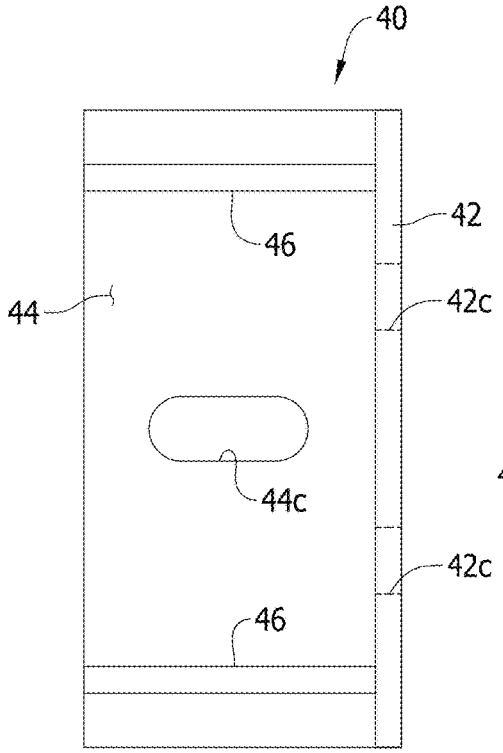
Figure 4C:
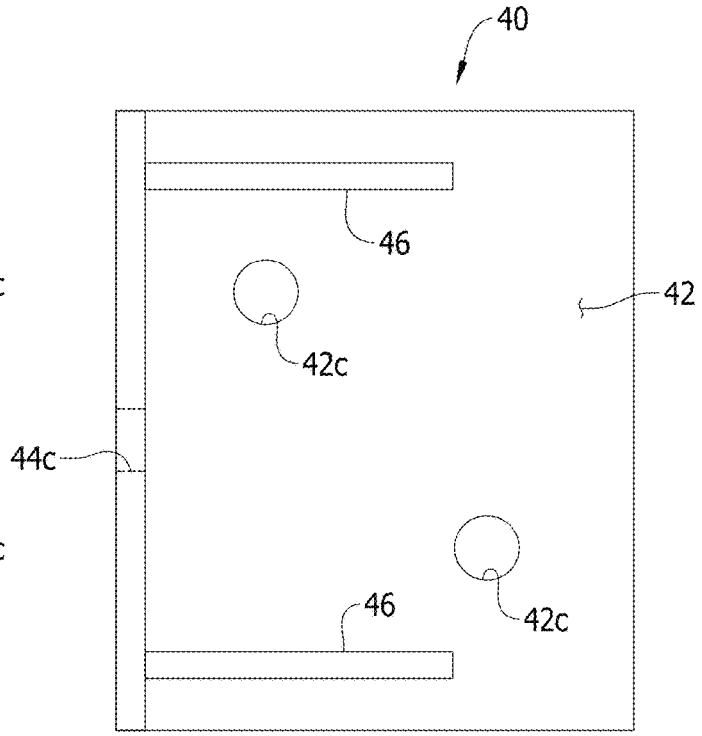

The center span 30 is supported by right and left floor joist mounts 40. The right and left floor joist mounts are mirror images of each other, thus, only one of the floor joist mount is shown in FIGS. 4A-C. Each floor joist mount 40 includes a mounting (or joist facing) plate 42 and a back (or wall facing) plate 44. The mounting plate 42 has inner and outer surface 42*a,b*; and the back plate has front and back surfaces 44*a,b*. A pair of stiffeners 46 (shown to be triangular) extend generally perpendicularly form the mounting plate 42 and back plate 44. As will become apparent, the floor joist mounts, when secured to the floor joists are arranged such that the stiffeners each lay in a generally horizontal plane and are vertically aligned—that is, one stiffener 46 is vertically above the other. The stiffeners 46 have edges 46*a,b* which are fixed (such as by welding) to the mounting plate 42 and back plate 44 floor joist brackets. The stiffeners are preferably generally right triangles wherein the two edges are of approximately equal length. Lastly, the floor joist mounts each include a pair of mounting holes 42*c* in the mounting plate and an elongate opening 44*c* in the back plate 44. The elongate opening has a major axis that extends generally parallel to the plane of the stiffeners 46. The mounting holes 42*c* are shown to be diagonally off set from each other, but could be aligned such that their centers define a line generally parallel to the back plate 44.

In a preferred embodiment, the floor joist mounts 40 have a height of about 6". The mounting plate 42 has a front-to-back depth of about 5" and the back plate 44 has a width (along its back surface) of about 3". The edges 46*a,b* of the stiffeners 46 each have a length of about 2¾. The mounting holes 42*a* in the mounting plate 42 and the elongate opening 44*a* in the back plate 44 are all sized to accept a ⅝ diameter bolt. The elongate opening 44*c* preferably has a length of about 1½ ". The floor joist mounts are preferably made from ¼" thick steel plating, but could be formed from any material which can withstand the forces to which the floor joist mounts 40 will be subject when installed.

Figure 5A:
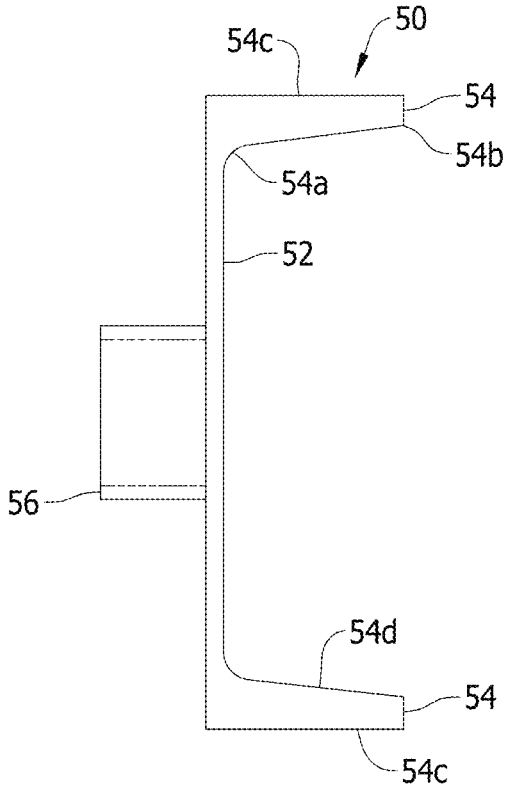
FIGS. 5A-B are side and back elevational views, respectively, of a beam top connector of the foundation support system.
Figure 5B:
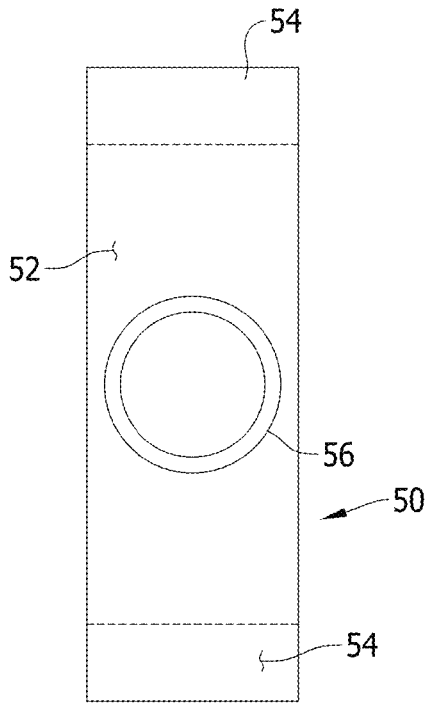

The top beam connector 50, shown in FIGS. 5A-B, is in the shape of a channel member, and comprises a face plate 52 with arms 54 extending forwardly from the face plate 52. The arms 54 are generally trapezoidal in shape, with a base 54*a*, adjacent the face plate, that is wider than the distal end 54*b* of the arms. The outer surface 54*c* of the arms are generally perpendicular to the face plate and the inner surface 54*d* of arms slopes from the base to the distal end. The distance between the bases 54*a* of the arms 54 is slightly greater than the width of the support beam 20, such that the support beam 20 can be positioned between the arms 54. Preferably, the distance between the bases 54*a* of the arms 54 is not more than 1" (and more preferably not more than ½") greater than the side-to-side width of the support beam 20. A hollow, preferably cylindrical, tube 56 extends from the rear surface of the face plate 52, and thus extends in an opposite direction from the arms 54. The tube 56 is generally centered (both length wise and height wise) relative to the face plate 52. Preferably, the face plate is solid, and there is no hole in the face plate aligned with the hollow tube 56. The hollow tube 56 thus defines a passage or hole that is closed by a back surface of the face plate 52.

In a preferred embodiment, the top beam connector 50 has a side-to-side width of about 6" (along the back surface of the face plate 52) and a depth of about 2" (along the outer surfaces 54*c* of the arms 54). The distance between the bases 54*a* of the arms 54 on the front surface of the face plate is about 5". The hollow tube 56 has a length of about 1" and is sized to accept a 1¼" diameter bolt.

Figure 6A:
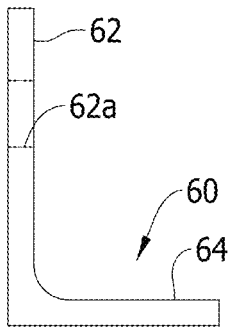
FIGS. 6A-B are side and front elevational views, respectively, of a floor bracket of the foundation support system.
Figure 6B:
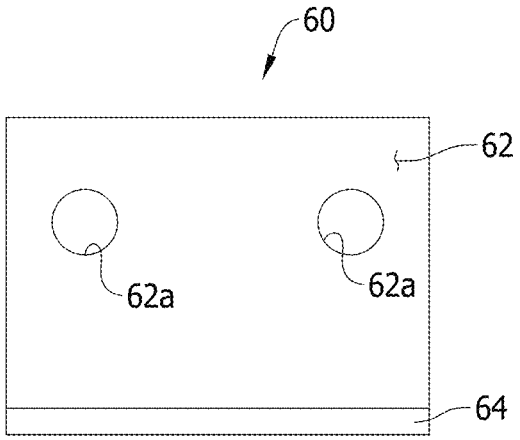
Figure 7:
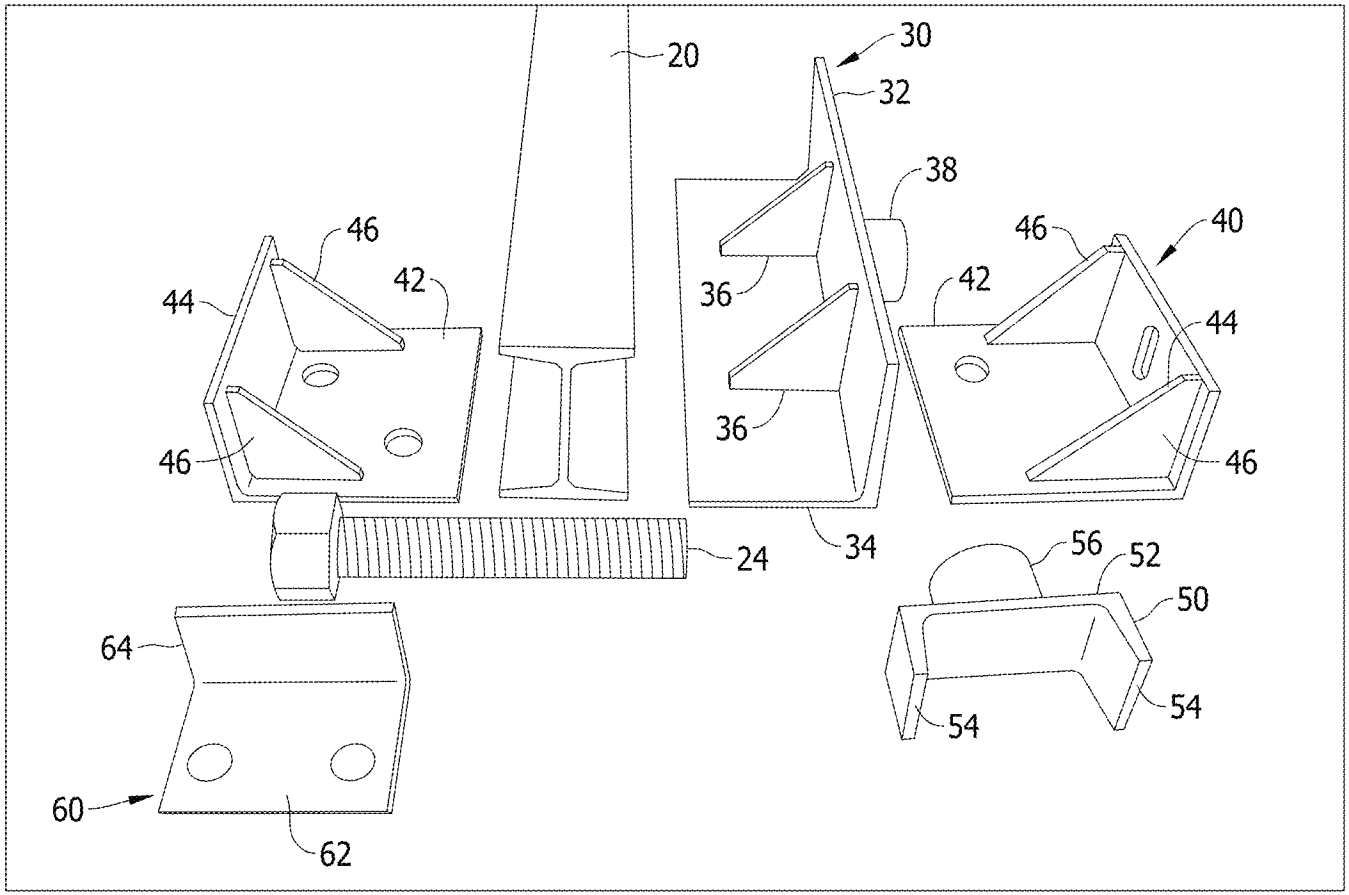
FIG. 7 is a perspective view of the components of the foundation support system in a disassembled state with the upper perpendicular bracket.

The toe or floor bracket 60, shown in FIGS. 6A-B, is generally in the form of an L-bracket and has a floor plate 62 and a front plate 64. A pair of mounting holes 62*a* are formed in the floor plate 62. The front plate 64 can be solid, i.e., it can be formed without any holes. In a preferred embodiment, the toe or floor backet as a side-to-side width of about 4" (which corresponds generally to the width of the support beam 20). The mounting holes are sized to receive ⅝ diameter bolts. Like the center span and the floor joist mounts, the floor bracket is preferably formed from ¼" steel, but could be formed from any material which can withstand the forces to which the floor backet 60 will be subject when installed.

To install the foundation support system 10, initially, the position of the support beams 20 along the wall is determined. The position of the beams and the number of beams to be installed along a wall depends on factors such as the wall height, type of wall construction, wall reinforcing and thickness, wall backfill height, water impoundment, and wall deterioration. The beams are all cut to height, such that when the beam 20 is on the floor plate 62 of the of the floor bracket 60, the top of the beam will extend above the top of the wall, and preferably be slightly below the top of the joist. The beams 20 can be positioned along the walls at this point.

Figure 2A:
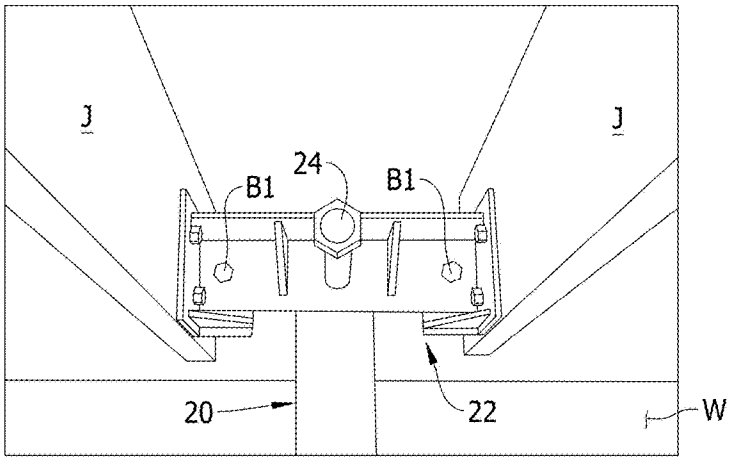
FIGS. 2A-D are enlarged perspective views of the connection of the perpendicular foundation support system of FIG. 1A to the basement ceiling taken different angles.
Figure 2B:
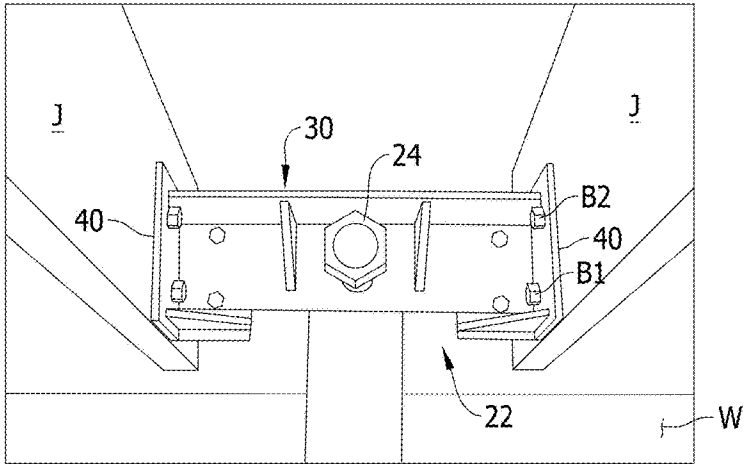
Figure 2C:
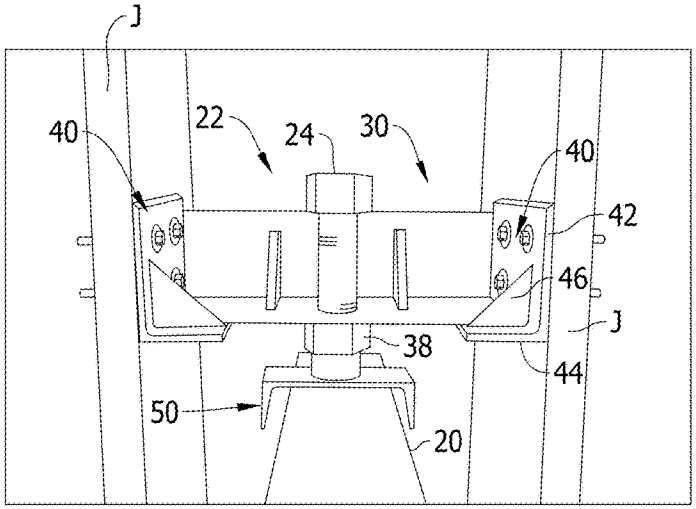
Figure 2D:
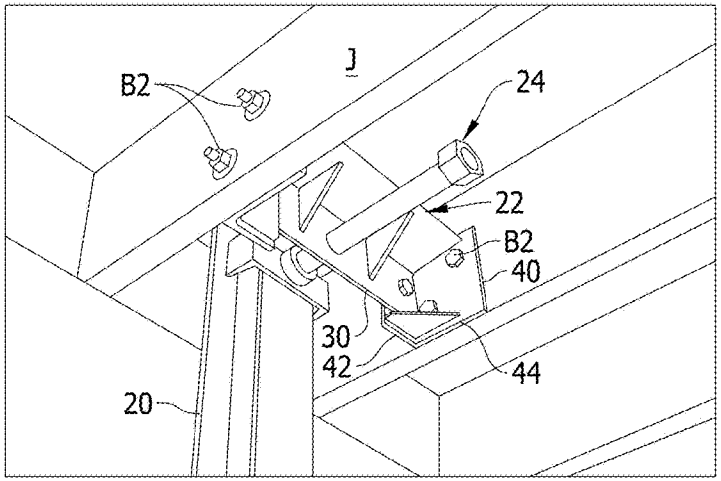
Figure 2F:
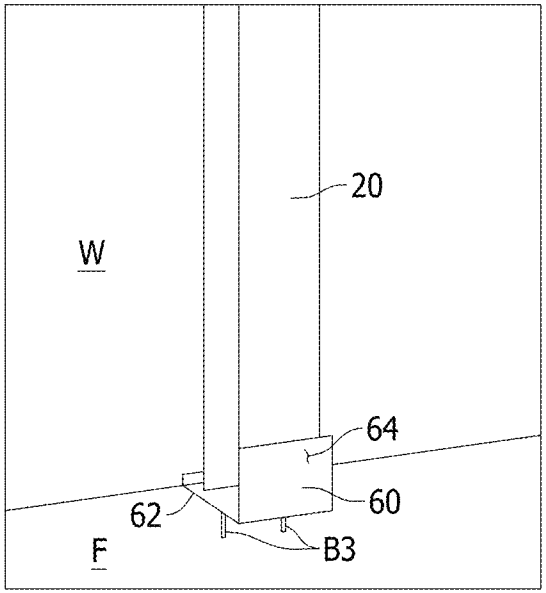
FIG. 2F is a perspective view of the bottom of the support beam positioned in a toe bracket.
Figure 2E:
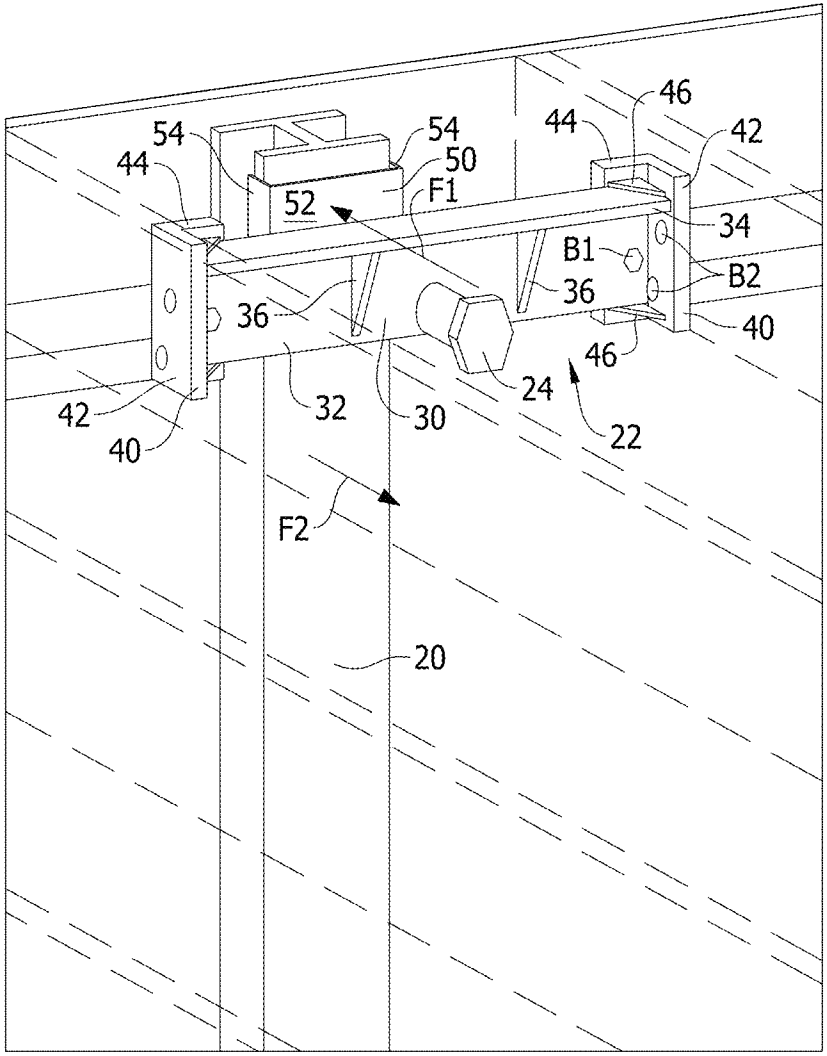
FIG. 2E is a schematic perspective view of the top of the foundation support system, showing a support beam in position to provide support to a foundation wall, with joists shown in phantom.

The center span 30 is loosely assembled to the left and right floor joist mounts 40 by passing bolts B1 (FIGS. 2A,E) through the holes 32*d* of the center span into the elongate holes 44*c* of the back plate 44 of the floor joist brackets. This loose connection will allow the floor joist mounts 40 to move relative to the center span 30. As seen in FIG. 2E, the center span will be sandwiched by the stiffeners 46 of the floor joist brackets, with the bottom edge of the center span back plate 32 being above the bottom floor joist stiffener, and the top plate 34 of the center span being below the top floor joist stiffener. The floor joist stiffeners 46 are spaced apart a distance to allow for the center span 30 to be easily slid into place between the floor joist stiffeners 46. For example, there can be ½" or less (and preferably ¼" or less) of clearance on either side of the center plate.

At this point, the torque bolt 24 can be passed through the center hole 32*a* of the center span back plate 32 and threaded through the bolt 38.

The floor joist mounts 40 are then secured to adjacent joists J using bolts B2 (FIGS. 2D,E) which pass through the mounting holes 42*c* in the mounting plates 42. The right and left floor joist mounts 40 are mounted to facing surfaces of adjacent joists J such that their respective back plates 44 extend toward each other and are aligned with each other on a plane that is generally parallel to the basement wall W. That is, the back plates 44 of the floor joist mounts are generally co-planar. The floor joist mounts 40 are positioned on the floor joists such that their back plates 44 are spaced from the basement wall W by a distance greater than the depth of the support beam 20. Thus, main plate 32 of the center span 30 will also be generally parallel to the wall W. Once the floor joist mounts 40 are tightened in place, the center span 30 is moved relative to the floor joist mounts 40 as may be necessary so that the center span is generally centered between the floor joists J. As can be appreciated, the elongate openings 44*c* in the back plate 44 of the floor joist mounts allow for the adjustment of the position of the center span 30. These elongate openings could, instead, be formed in the main plate 32 of the center span. In this instance, the mounting holes 32*d* of the main plate would be replaced with elongate holes, and the hole 44*a* in the floor joist mount back plate 44 could be a circular hole.

With the upper bracket assembly 22 in place, the top beam connector 50 can be put in place. The top beam connector 50 is positioned such that its arms 54 extend around the support beam 20 and its front surface is in contact with the support beam 20. The top beam connector 50 is positioned along the support beam 20 such that the cylinder 56 of the top beam connector is aligned with the torque bolt 24. The torque bolt 24 is then advanced to be received in the cylinder 56 of the top beam connector 50 to loosely hold the beam 20 in place in position against the wall W.

The toe bracket 60 (which may have been previously positioned) is secured to the floor F using bolts B3 (FIG. 2F) which pass through the mounting holes 62*a* of the floor plate 62. The floor bracket 60 is positioned on the floor F to be generally centered between the joists J, such that the support beam 20 will extend generally vertically upwardly to reach between in front of the torque bolt 24 of the center span 30. If necessary, the position of the base of the support beam 20 is adjusted so that the support beam 20 will extend generally vertically between the floor bracket and the upper bracket. The toe bracket is oriented such that the front plate 64 is generally parallel to, and spaced from the wall a distance generally equal to the front-to-back width of the support beam 20, such that the toe bracket 60 will maintain the bottom of the support beam in surface contact with the bottom of the basement wall. Thus, as seen in FIG. 2F, the front plate 64 of the toe bracket is adjacent an outer face of the support beam 20. The toe bracket is preferably arranged such that the support beam 20 sits on the floor plate 62 of the toe bracket 60. However, the toe bracket could be oriented such that the support beam 20 rests directly on the floor F, with the floor plate 62 extending away from the support beam 20. In either case, the toe backet 60 will retain the base of the support beam 20 adjacent the wall W.

Importantly, the torquing member 24 positively engages the passage to substantially prevent the torquing member from retracting from said passage after torquing member has been advanced. In the disclosed embodiment, this positive engagement is accomplished by means of the treads on the torque bolt and passage 38. However, positive engagement could be accomplished via other means. For example, the torquing member 24 could be advanced by a ratcheting mechanism. In this instance, the threads torquing member and the tube 38 would be replaced with ratchet teeth which would maintain the torquing member in place longitudinally relative to the tube 38 and the upper bracket (or main plate) against the counter forces F2 exerted by the foundation wall against the support beam 20. Other methods of advancing the torquing member can also be envisaged by those of skill in the art.

The above-steps are repeated for each of the support beams 20 to be used to support the wall W. After all the beams 20 are in place, the torque bolts 24 for each beam 20 are threaded forwardly, such that the beam top connectors engage and bear against the beams 20. The system 10 (with the support beam 20 held in place at its bottom by the floor bracket and forced against the wall at its top by the torque bolt 24 and beam top connector 50) will apply spring-like forces F1 (FIGS. 1A and 2E) to the beam 20 which will urge the beam 20 against the wall. The urging of the beams 20 against the wall W will counteract the external hydrostatic forces being applied against the outer surface of the wall by the soil to thus support, and, if possible, straighten the wall W. As can be appreciated, opposing forces F2 pass from support beam 20, to the upper bracket 22 and the joist mounts 40 to pass into the joists J. The amount of torque applied by each torque bolt 24 may vary based on the location of the beams along the wall (that is, the forces exerted by the beams against the wall may not all be the same). Further, the forces exerted by the beams (and thus the amount of torque to be applied by the torque bolts) will be based on the strength of the hydrostatic forces being exerted against the outer surface of the wall W and the amount of tilting, cracking, or bowing of the wall W.

As can be appreciated, the wall support system 10 does not require any external excavation of the foundation; nor does it require that any holes be bored in the foundation wall. This thus makes the wall support system 10 easier to install and potentially less expensive to be installed.

Figure 8A:
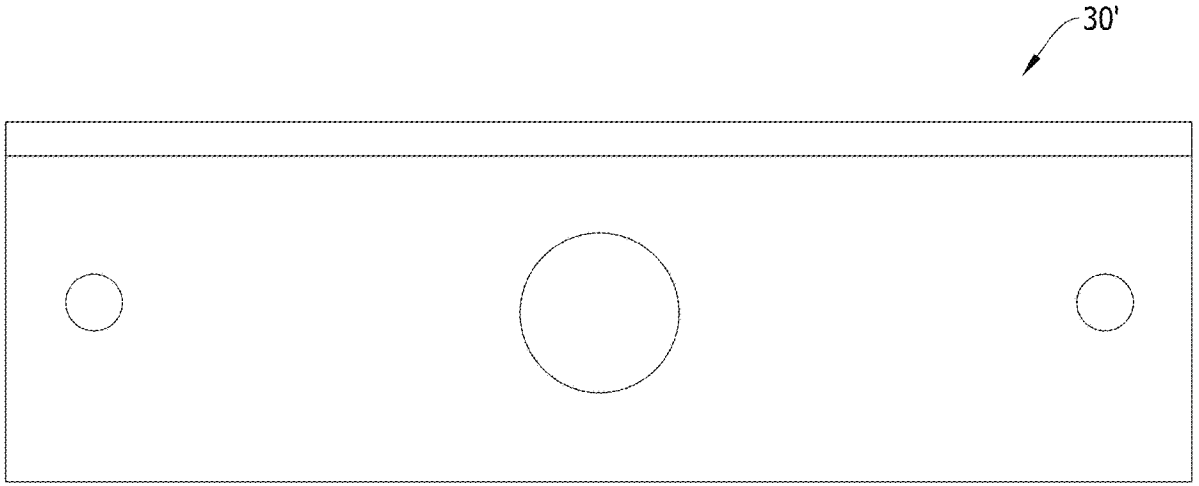
FIGS. 8A-B are front and side elevational views of an alternative center span for the upper perpendicular bracket which does not include stiffeners.
Figure 8B:
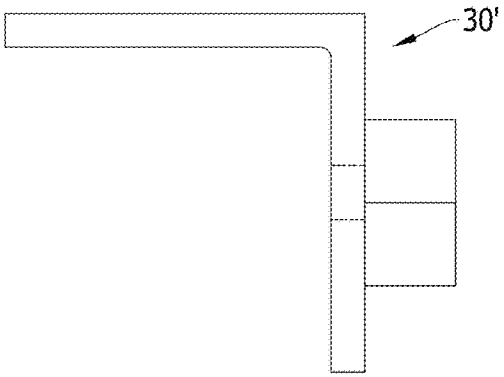
Figure 9A:
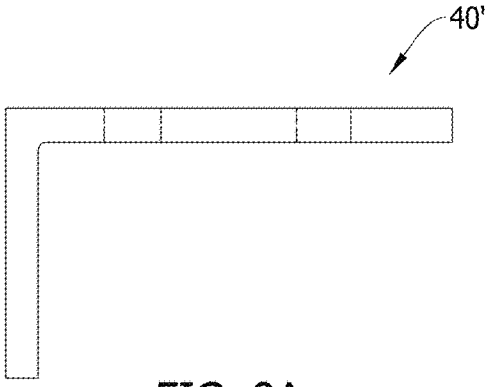
FIGS. 9A-C are bottom plan, side elevational, and front elevational views, respectively, of an alternative floor joist mount for the upper perpendicular bracket which does not include stiffeners.
Figure 9C:
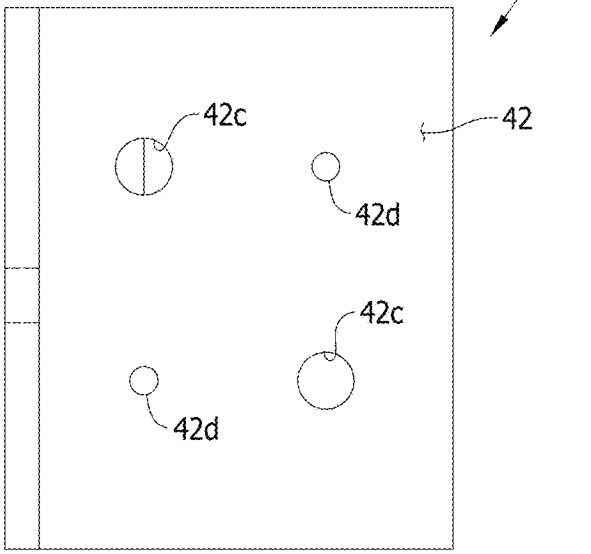
Figure 9B:
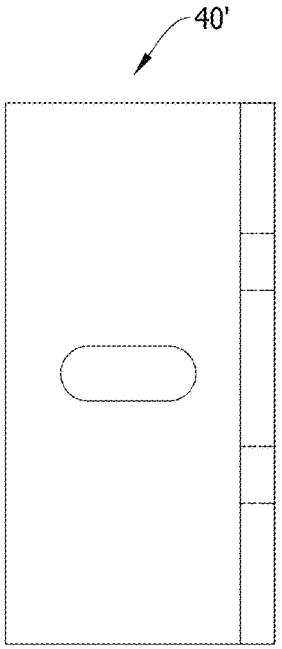

An alternative center span 30' is shown in FIGS. 8A-B, and an alternative floor joist mount 40' is shown in FIGS. 9A-C. The center span 30' and floor joist mount 40' are generally identical to the center span 30 and floor joist mount 40, except that the center span 30' and floor joist mount 40' do not have stiffeners or gusset plates, as do the center span 30 and floor joist mount 40. To account for the loss of the stiffeners, the center span 30' and floor joist mount 40' are formed from thicker material. Whereas the center span 30 and floor joist mount 40 were preferably ¼" (about 6.4 mm) thick, the center span 30' and floor joist mount 40' are each preferably ⅜" (about 9.5 mm) thick. FIG. 9C also shows an alternative arrangement of holes in the mounting plate 42. As seen in FIG. 9C, in addition to the mounting holes 42*c* the floor joist mount includes holes 42*d* which are smaller than the holes 42*c* are and sized to accept screws which can pass through the mounting plate 42 into the joist. The four holes define a rectangle, which each hole at a corner of the rectangle. The two holes 42*c* are at diagonally opposite corners and the two holes 42*d* are at diagonally opposite corners of the rectangle. The holes 42*d* could, of course, also be provided on the floor joist mount 40.

Figure 10A:
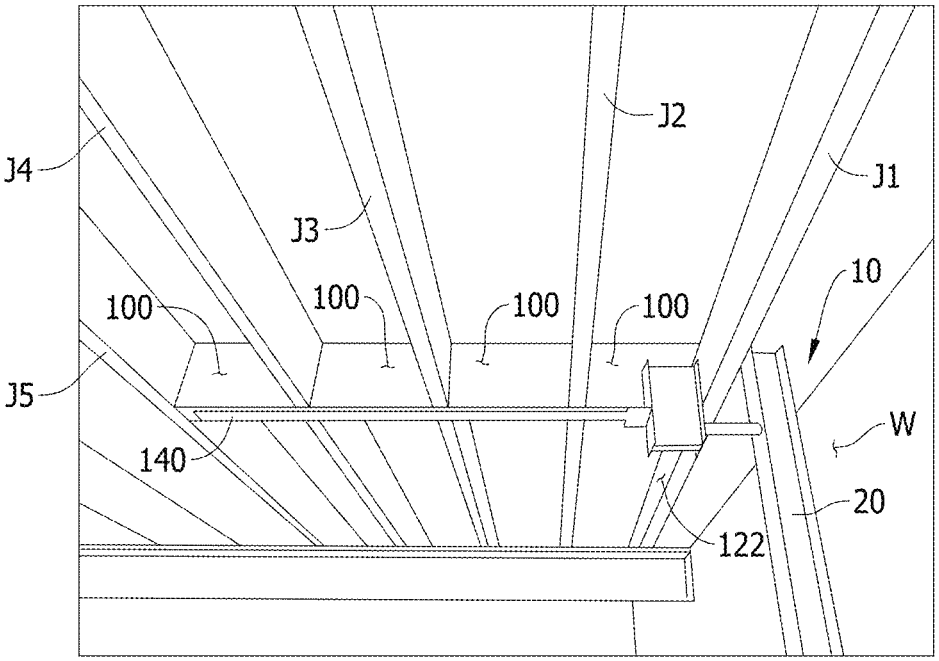
FIGS. 10A-B are perspective views off the wall support system in which the joists run parallel to the wall to be reinforced.
Figure 10B:
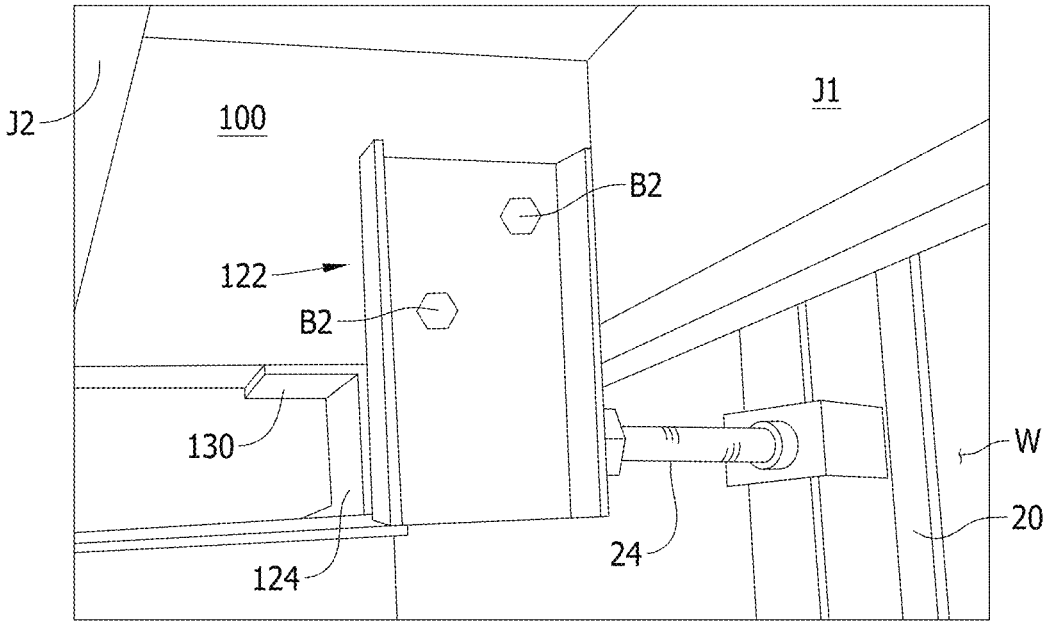
Figure 11:
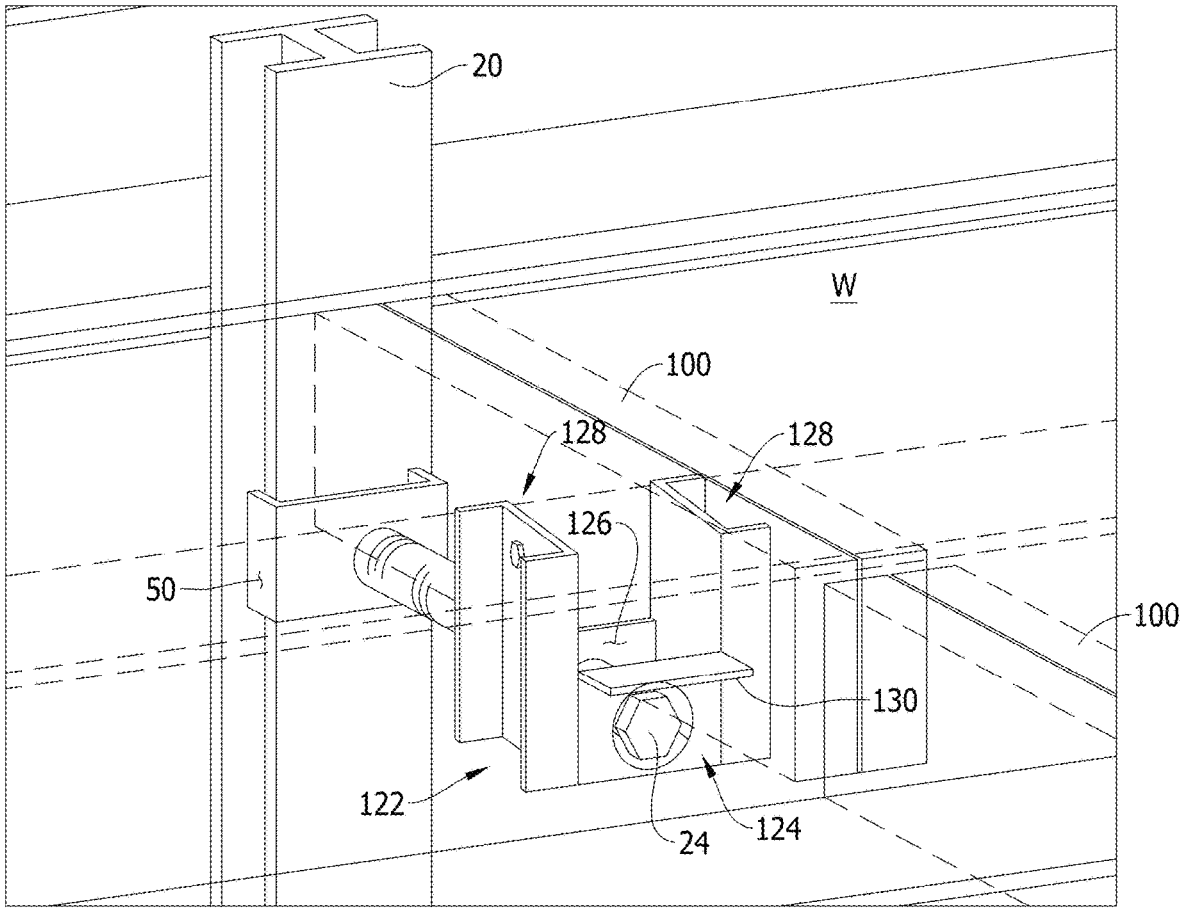
FIG. 11 is a perspective schematic view of the wall reinforcement system with joists and blocking shown in phantom, with the upper parallel bracket shown mounted to the bracing.
Figure 12A:
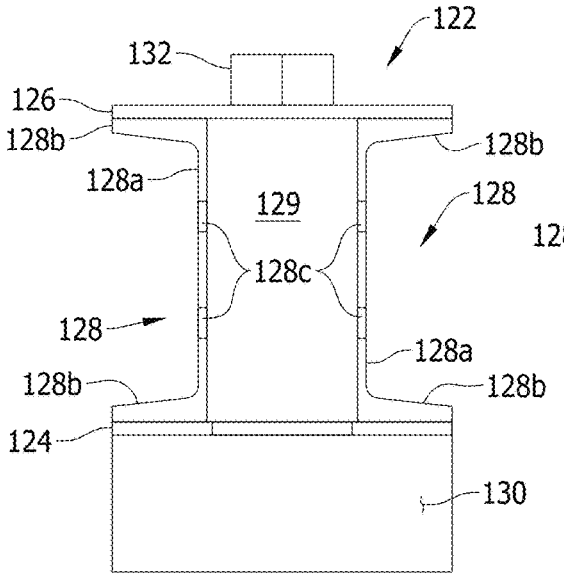
FIGS. 12A-D are top plan, front elevational, back elevational, and side elevational views, respectively, of an upper parallel bracket.
Figure 12B:
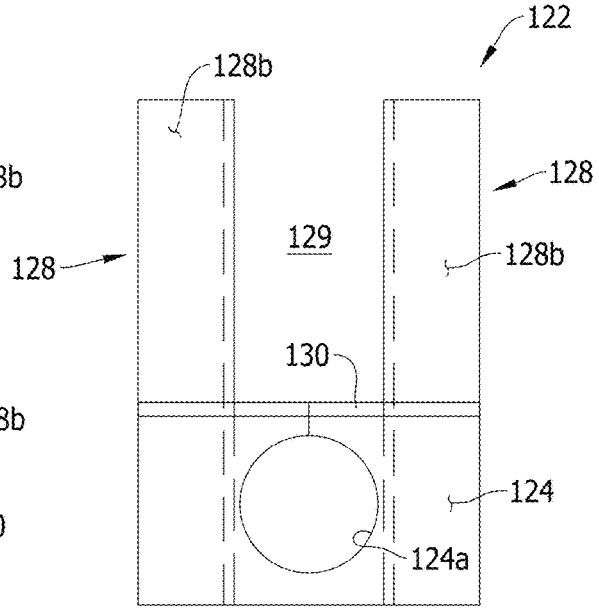
Figure 12C:
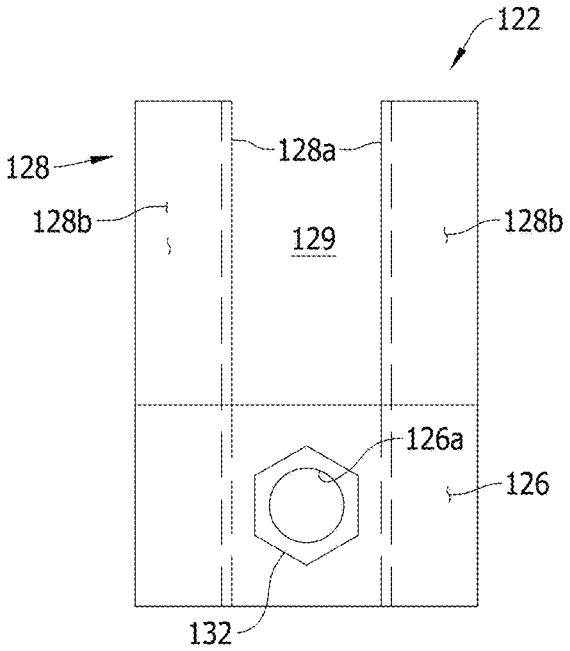
Figure 12D:
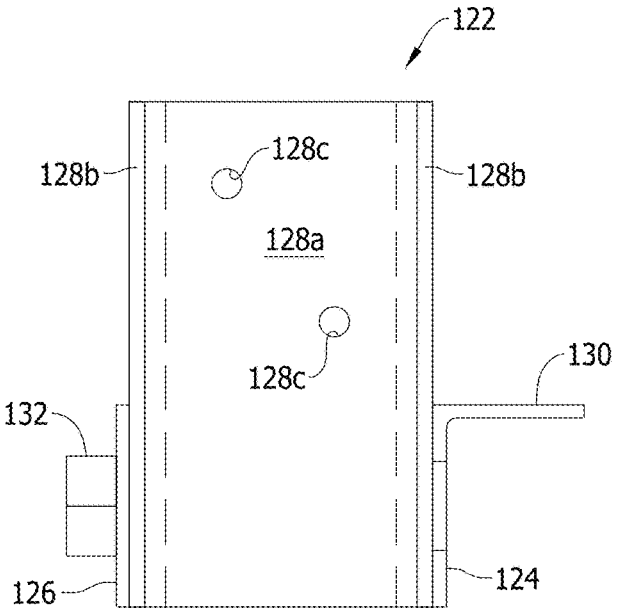

The upper bracket 22 shown in FIGS. 2A-E is, as noted, are for use in systems 10 wherein the joists run perpendicular to the wall to be supported. FIGS. 10A-B show the wall support system 10 for to support a foundation wall wherein the joists run parallel to the wall to be supported, and FIGS. 11-12D show an upper perpendicular bracket 122 for use in this parallel system. Because the joists J extend parallel to the wall to be reinforced or supported, the bracket system 22 of FIGS. 2A-E cannot be used. Further, because of the forces exerted by the support system 10 against the wall, the forces cannot be borne by a single joist extending parallel to the wall. In this instance, the forced applied by the system will be generally perpendicular to the joists, and the forces would bend, and possibly crack or break, the joist J1 closest to the wall W to be supported. Thus, at each location along the wall W where beams 20 are to be placed, blocking 100 (FIGS. 10A-11) is placed between adjacent joists, with the blocking 100 extending generally perpendicular to the wall W to be supported. Blocking is not positioned between the wall W and the first joist J1, as this is where the beam 20 will be positioned. However, there are two, and preferably at least four, levels of blocking between the joists J1-J5. That is, preferably, there is blocking 100 between joists J1 and J2, blocking 100 between joists J2 and J3, blocking between joists J3 and J4, and blocking between joists J4 and J5. As seen in FIGS. 10A and 11, the four levels of blocking are co-linear. The blocking 100 can comprise sections of lumber that have a side-to-side width totaling about 3" and a length sufficient to fit snuggly between adjacent joists J1/J2, J2/J3, J3/J4, and J4/J5. The torque bolt 24 and the top beam connector 50 are supported by a bracket system 122 which is mounted to the blocking 100 between the first and second joists J1,J2.

Referring to FIGS. 11-12D and 14, the bracket system 122 includes a front plate 124, a main or back plate 126, and opposed channel side members 128 which extend between the front and back plates at opposite ends thereof. The channel side members 128 each comprise a back plate 128*a* with flanges 128*b* extending outwardly to define an outwardly opening channel. The flanges 128*a,b* have flat outer surfaces which are generally perpendicular to the back plate 128*a* of the channel side members and sloped inner surfaces, such that the flanges are wider at their bases (adjacent the back plate 128) than at their free ends. The channel members 128 are spaced from each other to define a gap 129 between their back plates 128*a* having a distance slightly greater than the width of the blocking 100 so that the channel members can be received on opposite sides of the blocking. The front and main plates 124, 126 are sized to have a side-to-side length such that their opposite end edges are proximate the free ends of the flanges. The front and main plates 124, 126 are fixed to the side channel members 128 by any desired means, including welding, soldering, gluing, bolting etc. The side members 128 have a top-to-bottom length greater than the top-to-bottom length of the front and main plates 124, 126, and extend from the proximate bottom of the front and main plates above the tops of the front and main plates. A top plate 130 extends forwardly from, and generally perpendicular to, the front plate 124. Preferably, the top plate 130 has a side-to-side width generally equal to the width of the gap between the side members 128. The front and main plates 124, 126 are sized such that the top edge of the main plate will be even, level, or coplanar with the top surface of the top plate 130. As seen in FIG. 12D, the top plate 130 is well below the top of the side members 128. If desired, the front plate 124 and top plate 130 can be formed together from an angle iron. A socket hole 124*a* is formed in the front plate generally centered between the side channel members 128; a bolt hole 126*a* is formed in the back plate 126 concentrically with the socket hole 124*a*; mounting holes 128*c* are formed in the back plates 128*a* of the side members 128 above the tops of the front and back plates; and an internally threaded member 132, sized to threadedly receive the torque bolt 24 extends from the main plate 126 to face away from the front plate 124. The internally threaded member 132 can be, for example, a bolt which is fixed to the front plate 124.

In a preferred embodiment, the front plate (inclusive of the top plate) and the main plate each have a height of about 4" and a width of about 6¾". The top plate, however, preferably has a width generally equal to the distance between the side channel members (or about 3"). The side members 128 have a height of about 10" and the outer surfaces of the flanges have a depth of about 1.9". The bolt hole 126*a* is sized to accept a 1¼" diameter bolt, and the socket hole 124*a* is sized to receive a socket which can drive the bolt. The mounting holes 128*c* in the side channel members are sized to accept ⅝" bolts. Preferably, the side channel members are mirror images of each other, such that the mounting holes on one channel member are aligned with the mounting holes on the other channel member.

Installation of the wall support system on parallel joists is generally the same as perpendicular joist. However, the upper bracket 122 is used rather than the upper bracket 22. To mount the upper bracket 122, the upper bracket is positioned around the blocking 100 between the first two joists J1,J2 such that the top plate 130 is against the bottom of the blocking 100, and the side members 128 are on opposite sides of the blocking. The fit should be such that the upper bracket 122 does not rotate. The top plate 130 helps to prevent rotation of the bracket 122 about the blocking 100. Bolts B2 (FIG. 10B) are passed through the mounting holes 128*c* into the blocking 100. If desired, the bolts B2 can be sufficiently long to pass through one side member, through the blocking, and to exit through the opposite side member to receive a nut to secure the bolts in place. Alternatively, the bolts B2 can be sized to pass part way through the blocking 100. In this instance, the bolts could simply extend part way through the blocking (in which case the bolts would be in the form of screws), or the bolts could be received by threaded tubes which extend into the blocking from the opposite side of the blocking. Any other means could be used to secure the bracket to the blocking, as long as the manner of securing the bracket will withstand the forces to which the bracket will be subject.

Figure 13:
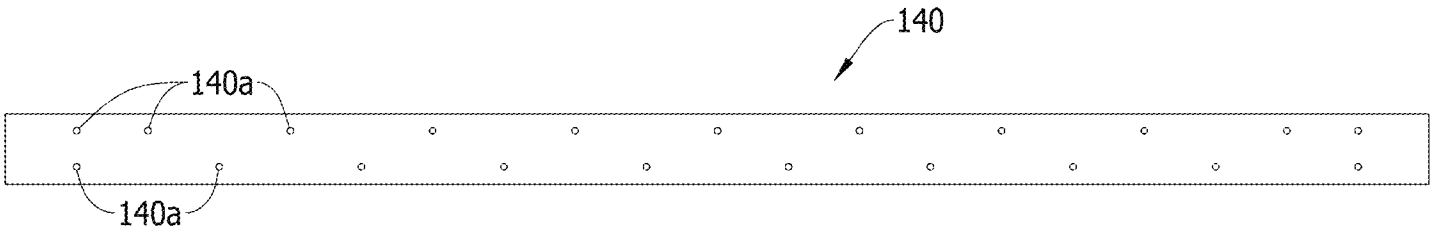
FIG. 13 is a plan view of blocking reinforcement strap for use with the upper parallel bracket.
Figure 14:
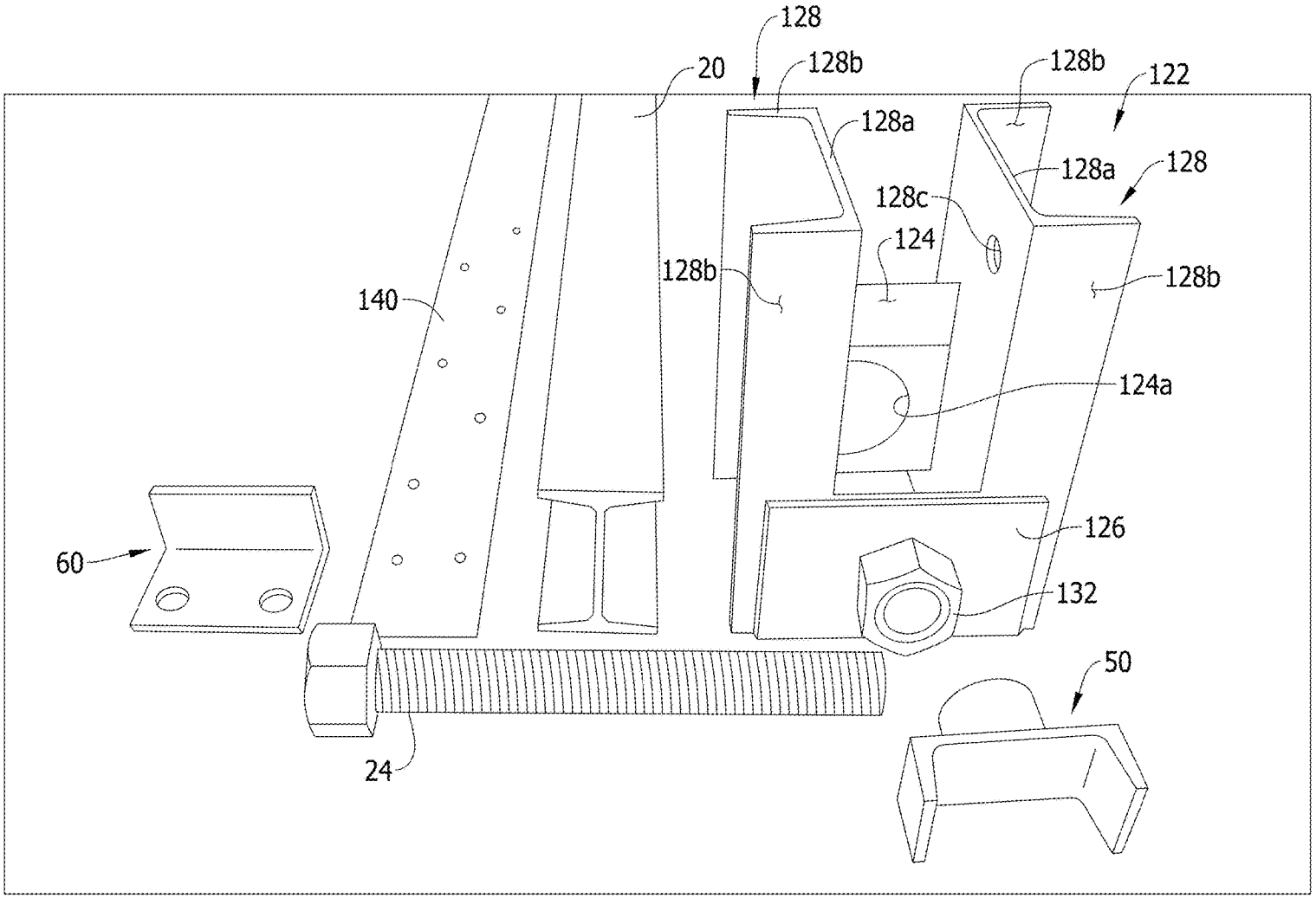
FIG. 14 is a perspective view of the components of the foundation support system in a disassembled state using an upper parallel bracket.

The torque bolt 24 is passed through the socket hole 124*a*, into the bolt hole 126*a* and threaded into the nut 132. Prior to torquing the bolts 24 (after all the beams 20 have been installed), a reinforcement strap 140 (FIGS. 10A and 13) is mounted to the bottom of the blockings 100. The reinforcement strap 140 comprises an elongate strip of, preferably, steel which secured to the blockings 100 starting from a point just behind the bracket (i.e., behind the top plate 130). The reinforcement strap 140 includes a plurality of holes 140*a* arranged in two rows through which fasteners, such as screws, nails, or the like, can be passed to secure the strap 140 to the blockings 100 and/or the joists J1-J5 to tie them all together as a system. After the straps 140 have been fixed in place, the torque bolts 24 can be tightened down to activate the system 10 to provide support to the wall W, as described above. The use of the blockings 100 and reinforcement strap 140, as noted above, avoids the forces generated by the system from being applied to just the first joist J1. Rather, the forces are transferred through the blocks 100 to, and spread among, at least the joists J1-J5. As with the upper bracket 22, the torque member 24 could be advanced relative to the upper bracket 122 via any desired means, such as ratcheting means.

As various changes could be made in the above constructions without departing from the scope of the claimed invention, it is intended that all matter contained in the above description or shown in the accompanying drawings shall be interpreted as illustrative and not in a limiting sense. For example, internally threaded member 38, 132 extending from the upper brackets 22, 122 could be omitted, and replaced with an internally threaded passage formed in the bracket. the top beam connector 50 could be rotatably secured to the torque bolt in any manner which would allow the torque bolt to rotate relative to the top beam connector.

Depending on the manner of connection, the tube 56 of the top beam connector may not be needed and can be omitted. As another alternative, the tube 56 could be replaced with a blind hole in the plate 52 sized to receive the torque bolt 24. In the upper bracket 122, the side members 128 could be formed as plates, rather than as channel members. Further, the portion of each side member 128 extending above the front and main plates 124, 126 could comprise two side member pieces which are spaced from each other. these variations and alternatives are illustrative only.

The invention claimed is:

1. A wall supporting system for supporting a foundation wall against forces applied externally to the wall; the system comprising:

a support beam having a bottom end and a top end;

a floor bracket adapted to maintain the bottom end of the support beam adjacent the foundation wall; and an upper bracket; the upper bracket comprising:

a main plate arranged to be generally parallel to the foundation wall when the wall supporting system is in place;

a passage through said main plate, said passage being open at opposite ends and defining an axis generally perpendicular to said main plate;

a torquing member being received in said passage; said torquing member being movable through said passage; and a beam connector at an end of said torquing member; whereby, advancement of said torquing member relative to said main plate will advance said beam connector to urge said support beam into a compressive relationship with said foundation wall, said torquing member and said passage being shaped and configured to positively engage each other such that said torquing member will be substantially prevented from retracting from said passage after torquing member has been advanced;

wherein said upper bracket comprises opposed joist mounting members and a center span extending between said joist mounting members; said center span comprising said main plate; wherein said center span is adjustably connected to said joist mounting members.

2. The wall supporting system of claim 1, wherein said passage is a threaded passage, and said torque member comprises a torquing bolt which is at least partially threaded; wherein said torquing bolt can rotate relative to said beam connector, such that said beam connector remains generally rotationally fixed in position relative to support beam as said torquing bolt is advanced.

3. The wall supporting system of claim 1 wherein said beam connector comprises a face plate and arms extending from said face plate in a direction to extend away from said main plate, such that said connector defines a channel sized to receive said support beam.

4. The wall supporting system of claim 3 wherein said arms of said beam connector comprise a base adjacent said face plate and a distal end, said arms being wider at their bases than at their free ends.

5. The wall supporting system of claim 1 wherein said beam connector comprises a hole sized to rotatably receive said torque bolt.

6. The wall supporting system of claim 5 wherein said hole is defined by a hollow tube 3 extending from said face plate of said beam connector.

7. The wall supporting system of claim 1 wherein said joist mounting members each comprise a side plate and a back plate; said back plate comprising an opening and said main plate comprising opposed mounting openings proximate opposite ends of said main plate; said wall supporting system further comprising fasteners extending through said openings of said joist mounting members and said main plate when aligned to secure said center span to said joist mounting members; wherein one of said openings is an elongate opening whereby the relative position of said center span relative to said joist mounting members can be laterally adjusted.

8. The wall supporting system of claim 1 wherein said center span comprises a top plate extending generally perpendicularly to said main plate.

9. The wall supporting system of claim 1 wherein either or both of said center span and said joist mounting members comprise at least one stiffening plate.

10. A method of installing the wall support system of claim 1 to reinforce a foundation wall of a building; said building including a floor at a bottom of said foundation wall and a ceiling at a top of said foundation wall; said ceiling comprising joists; said method comprising:

positioning the support beam adjacent said wall (W); said support beam having a height such that an upper end of said support beam is above a bottom surface of said joists when a bottom of said support beam is at said floor;

securing the floor bracket to the floor to maintain the bottom of said support beam adjacent a bottom of said foundation wall;

mounting the upper bracket in the ceiling to be aligned with said support beam such that said beam connector is in contact with said support beam; and advancing said torque member to urge said support beam against said foundation wall to counter external pressures being applied against said wall.

11. The method of claim 10 wherein said joists extend generally perpendicularly to said foundation wall, said upper bracket comprising a center span and two floor joist mounts; said method comprising:

securing said floor joist mounts to adjacent floor joists; and securing said center span to said floor joist mounts in a position generally centered between said floor joist mounts.

12. The method of claim 11 including a step of loosely connecting said center span to said floor joist mounts prior to securing said floor joist mounts to said joists.

13. A wall supporting system for supporting a foundation wall against forces applied externally to the wall; the system comprising:

a support beam having a bottom end and a top end;

a floor bracket adapted to maintain the bottom end of the support beam adjacent the foundation wall; and an upper bracket; the upper bracket comprising:

a main plate arranged to be generally parallel to the foundation wall when the wall supporting system is in place;

a passage through said main plate, said passage being open at opposite ends and defining an axis generally perpendicular to said main plate;

a torquing member being received in said passage; said torquing member being movable through said passage; and a beam connector at an end of said torquing member;

whereby, advancement of said torquing member relative to said main plate will advance said beam connector to urge said support beam into a compressive relationship with said foundation wall, said torquing member and said passage being shaped and configured to positively engage each other such that said torquing member will be substantially prevented from retracting from said passage after torquing member has been advanced;

wherein said upper bracket comprises a front plate spaced forwardly of said main plate and side members extending between said front plate and main plate; said side members extending above upper edges of said front plate and main plate to define a gap therebetween.

14. The wall supporting system of claim 13 wherein said side members comprise a back plate.

15. The wall supporting system of claim 14 wherein said side members comprise flanges extending outwardly from said back plate.

16. The wall supporting system of claim 13 wherein said side members define at least one mounting hole; said mounting hole being above top edges of said front plate and main plate.

17. The wall supporting system of claim 13 wherein said front plate defines a hole aligned with said hole of said main plate, whereby said torque bolt can be accessed through said front plate.

18. The wall supporting system of claim 13 wherein said upper bracket includes a top plate extending from an upper edge of said front plate.

19. A method of installing the wall support system of claim 13 to reinforce a foundation wall of a building; said building including a floor at a bottom of said foundation wall and a ceiling at a top of said foundation wall; said ceiling comprising joists; said method comprising:

positioning the support beam adjacent said wall (W); said support beam having a height such that an upper end of said support beam is above a bottom surface of said joists when a bottom of said support beam is at said floor;

securing the floor bracket to the floor to maintain the bottom of said support beam adjacent a bottom of said foundation wall;

mounting the upper bracket in the ceiling to be aligned with said support beam such that said beam connector is in contact with said support beam; and advancing said torque member to urge said support beam against said foundation wall to counter external pressures being applied against said wall.

20. The method of claim 19 wherein said joists extend generally parallel to said foundation wall (W); said method comprising:

installing bracing between at least two adjacent joists; such that said bracing is aligned with said support beam (20);

mounting the upper bracket (122) to the bracing behind a joist closest to the wall (W); and mounting a reinforcement strap to the bracing and/or joists; said reinforcing strap having a forward edge positioned adjacent the upper bracket.

* * * * *